US008157263B2

(12) United States Patent
Noll, Jr.

(10) Patent No.: US 8,157,263 B2
(45) Date of Patent: Apr. 17, 2012

(54) ADJUSTABLE STACKER INFEED

(75) Inventor: Harry C. Noll, Jr., Allentown, PA (US)

(73) Assignee: Muller Martini Corp., Hauppauge, NY (US)

( * ) Notice: Subject to any disclaimer, the term of this patent is extended or adjusted under 35 U.S.C. 154(b) by 330 days.

(21) Appl. No.: 12/486,422

(22) Filed: Jun. 17, 2009

(65) Prior Publication Data

US 2010/0320059 A1 Dec. 23, 2010

(51) Int. Cl.
*B65H 29/20* (2006.01)

(52) U.S. Cl. ..... 271/315; 271/187

(58) Field of Classification Search ..... 271/187, 271/204, 277, 315; 270/52.25; 198/412, 198/470.1, 586, 605, 803.1
See application file for complete search history.

(56) References Cited

U.S. PATENT DOCUMENTS

| | | | | | |
|---|---|---|---|---|---|
| 1,972,460 | A | * | 9/1934 | Quick et al. | 271/315 |
| 4,058,202 | A | | 11/1977 | Reist et al. | |
| 4,345,682 | A | * | 8/1982 | White et al. | 198/635 |
| 4,418,856 | A | * | 12/1983 | George | 226/118.5 |
| 4,723,770 | A | | 2/1988 | Seidel et al. | |
| 4,801,132 | A | * | 1/1989 | Reist | 270/52.22 |
| 4,846,455 | A | * | 7/1989 | Hurst | 271/2 |
| 5,083,768 | A | | 1/1992 | Ertavi et al. | |
| 5,421,700 | A | * | 6/1995 | Kranz | 414/798.5 |
| 5,456,458 | A | | 10/1995 | Haupenthal | |
| 5,611,530 | A | | 3/1997 | Maresse et al. | |
| 5,692,740 | A | * | 12/1997 | Holtje | 270/58.01 |
| 5,975,525 | A | | 11/1999 | Hartmann et al. | |
| 6,131,904 | A | * | 10/2000 | Tomczak | 271/315 |
| 6,227,589 | B1 | | 5/2001 | Brown et al. | |
| 6,302,393 | B1 | * | 10/2001 | Beskitt et al. | 271/258.01 |
| 6,394,450 | B2 | * | 5/2002 | Kishine et al. | 271/315 |
| 6,612,563 | B1 | | 9/2003 | Noll, Jr. | |
| 6,612,567 | B1 | * | 9/2003 | Kaya | 271/206 |
| 6,705,608 | B2 | | 3/2004 | Kish et al. | |
| 6,764,073 | B2 | | 7/2004 | Kaya et al. | |
| 6,907,316 | B2 | | 6/2005 | Bader et al. | |
| 6,908,078 | B2 | | 6/2005 | Suzuki et al. | |
| 6,923,612 | B2 | * | 8/2005 | Hansl | 414/277 |
| 7,089,711 | B2 | | 8/2006 | Timmerman et al. | |
| 7,523,927 | B2 | * | 4/2009 | Stansch | 271/81 |
| 7,591,465 | B2 | * | 9/2009 | Sato | 271/187 |
| RE42,267 | E | * | 4/2011 | Michler et al. | 271/187 |
| 7,950,651 | B2 | * | 5/2011 | Wylie | 271/187 |
| 2004/0073330 | A1 | | 4/2004 | Bader et al. | |

* cited by examiner

*Primary Examiner* — Douglas Hess
(74) *Attorney, Agent, or Firm* — Lucas & Mercanti, LLP; Peter J. Phillips

(57) ABSTRACT

A stacker infeed machine providing adjustment of a gripper drum with respect to an overhead conveyor system. The infeed further provides for separate adjustment of a conveyor system with respect to the gripper drum without altering the vertical spacing between the gripper drum and the overhead conveyor.

6 Claims, 9 Drawing Sheets

ADJUSTABLE STACKER INFEED

FIELD OF THE INVENTION

This invention relates to an apparatus and method for conveying packages of newspaper inserts from an overhead conveyor to a stacking machine and, more particularly, to accommodating packages of varying lengths.

BACKGROUND OF THE INVENTION

The Sunday newspaper that is sold in many metropolitan areas typically comes bundled with a number of advertising and other inserts. The distribution system that places these in the hands of the reader is complex, and includes a number of specialized machines and assembly lines. At one stage, a variety of inserts may be placed into a folder called a package, and at another stage, the package is transported along a conveyor system to a place where these folders are stacked and bundled together for shipment to distributors. The lines used to accomplish all of this work are expensive and must work at a high rate of speed to justify their substantial investment of capital. Errors at any point along the line can result in expensive down time.

One such error can occur during the transfer of the package of inserts from an overhead conveyor system to a stacker machine where they are stacked and bound into a pile. It is known to affect this transfer via a rotary wheel of gripping devices known as a gripper drum. Typically, the package is gripped at its free ends by a gripper and transported via overhead conveyor to a point just above one of the grippers of the gripper drum, at which point the overhead gripper releases its grip, allowing the package to fall a short distance to the rotating grippers of the gripper drum, where they are gripped at their opposite, folded ends and rotated into position above a conveyor belt. Once there, the rotating grippers release their grip, and the packages fall onto a conveyor for transport to a stacker machine.

SUMMARY OF THE INVENTION

The aforementioned movements, when properly executed, are an exercise in mechanical cooperation, with each machine gripping and releasing the packages at the right time and at the right position in space. However, at times given streams of packages may vary in height, which can introduce errors into their transport and processing, as a gripper on the drum may fail to make proper contact with the package.

The invention provides an adjustable system in which packages are conveyed from an overhead gripper to a stacker via a rotating gripper drum that can be varied in height to accommodate variations in the effective height of the bottom edges of the packages as they are presented by the overhead conveyer. This is accomplished by an adjustment mechanism driven by a motor that varies the spacing of the rotary gripper drum with respect to the overhead conveyor.

In particular, the gripper drum, which is contained inside a drum frame, can be adjusted vertically by activation of a linear actuator that is affixed to an outer frame. The drum frame is provided with four lift links hanging off its corners, and when the drum frame is adjusted vertically, so too are the four lift links, which are attached at their opposite ends to a housing for a conveyor belt system suspended beneath the drum. This causes the gripper drum and the conveyor to translate together as a unit when the gripper drum's vertical position is adjusted.

The conveyor itself is composed of three subsections, each made up of elastic bands in parallel relation to one another. A first section is at approximately a 45 degree angle with the horizontal, and moves the package forward towards a second, centrally disposed conveyor section. This section remains horizontal throughout the operation of the stacker infeed, and conveys packages to the third section having a first end which overlaps the end of the second conveyor section, and a second, free end. Because the height of the central section can be adjusted, so toocan its ends, including the first end of the third section. On the other hand, it is generally desired that the free end of the third conveyor section remain in vertical registry with the inlet to the stacker, because the stacker generally is not vertically adjustable. To accommodate this constraint, the pulleys that support the elastic bands at the free end of the third section are mounted on a shaft that is free to move within a horizontal track located within a pair of side bars. When the central section is raised, so too is the first end of the third section, which causes the second, free end to translate horizontally along the track in the bars.

In addition to these adjustments, provision is made for these side bars to be further adjustable by rotation about a pivot point, which has the effect of adjusting the vertical height of the free end of the conveyor that feeds into the stacker. Such an adjustment is useful when mating the stacker infeed to the inlet of the stacker, as stackers themselves may vary in height. A set screw at the center of the bars is tightened to lock this position into place so that the free end of the conveyor is locked into a desired vertical position (while still being able to move generally horizontally to accommodate the other adjustments to the device).

The conveyor can be further adjusted vertically independently of the drum through a separate motor activated linkage system. Hence, in use, an initial adjustment is made to set the height of the gripper drum and a subsequent adjustment can be made to the height of the conveyor with respect to the gripper drum (which may be required by characteristics such as the thickness of the packages).

These and other aspects of the present invention will be more readily understood by reference to one or more of the following drawings which are presented for purposes of illustration.

DETAILED DESCRIPTION OF A PREFERRED EMBODIMENT

One embodiment of the invention will be described, but the invention is not limited to this embodiment.

Figure 1:
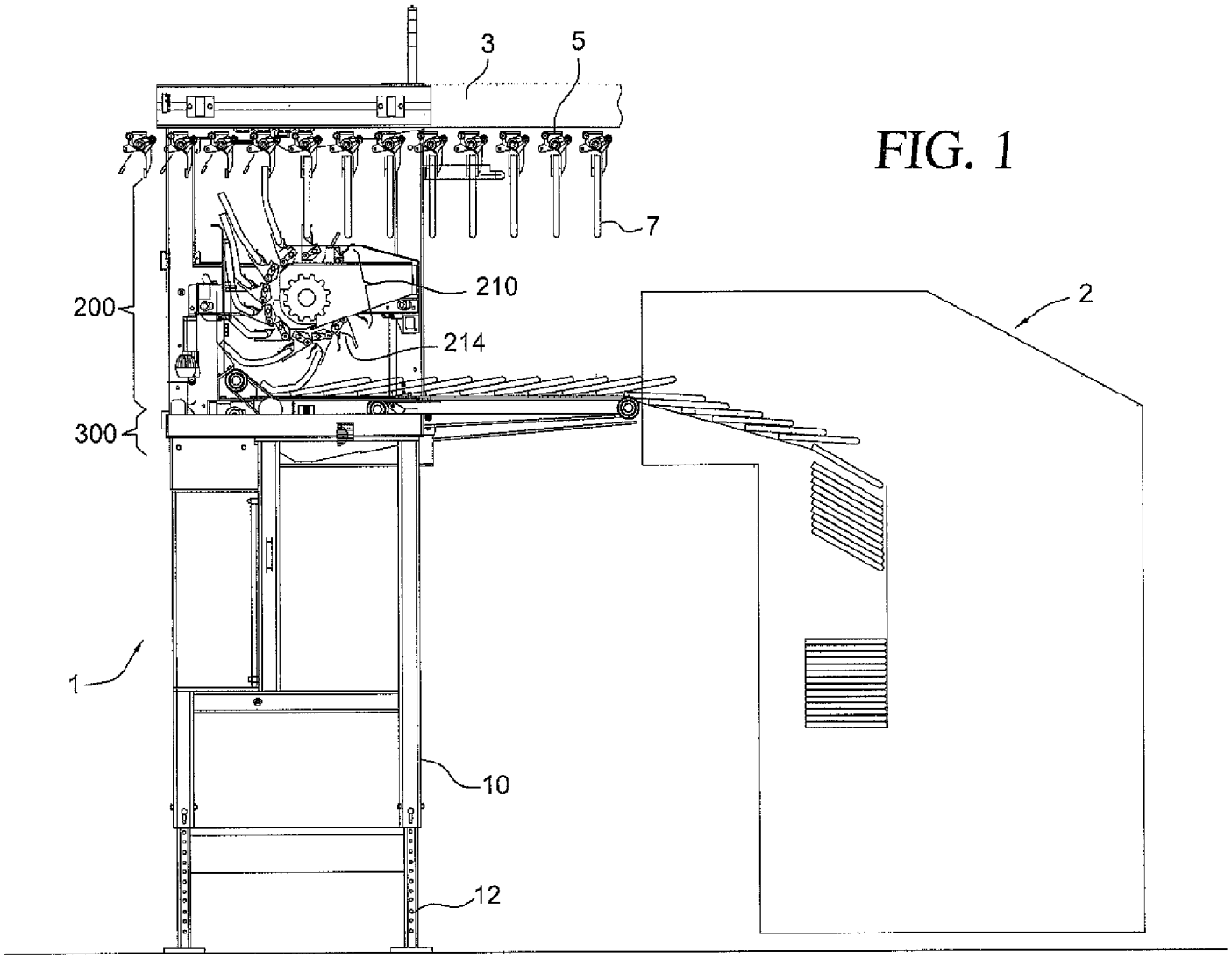
FIG. 1 is a schematic side elevational view of an embodiment of a stacker infeed in conjunction with an overhead conveyor and a stacker.
Figure 2C:
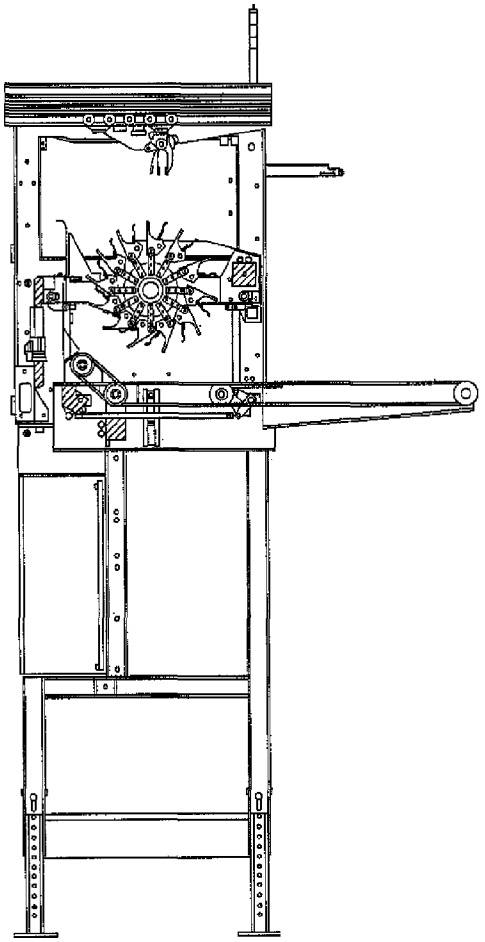
FIGS. 2*a*, 2*b*, and 2*c* show left side, rear, and right side views respectively of the stacker infeed depicted in FIG. 1.
Figure 2B:
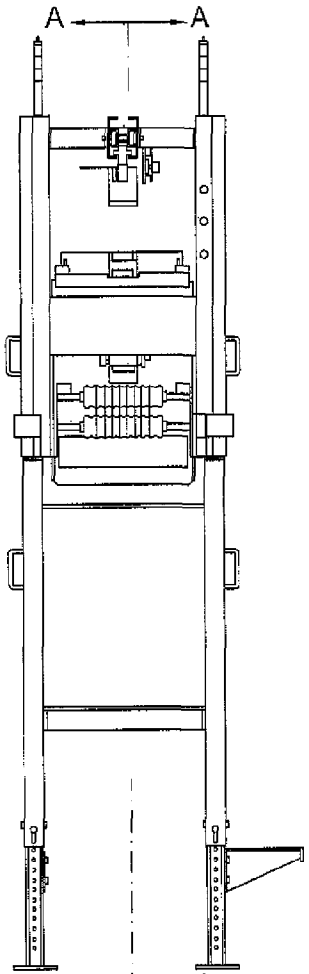
Figure 2A:
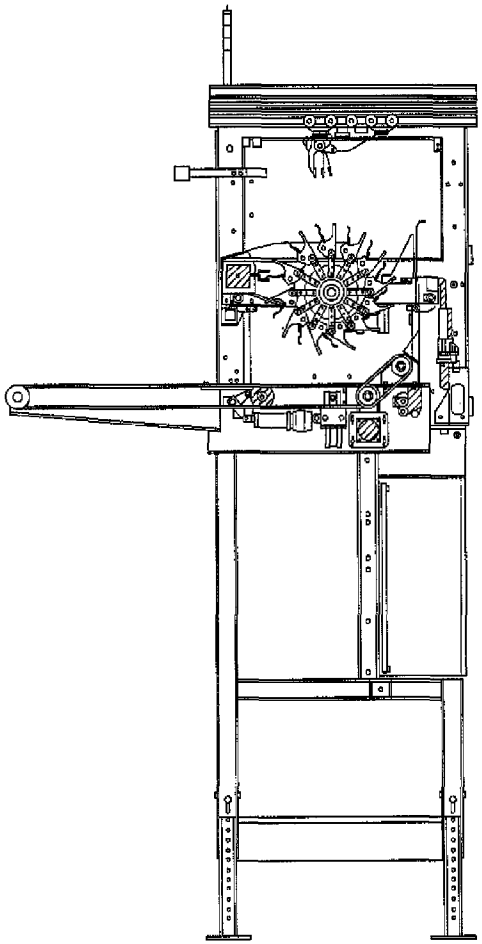
Figure 3:
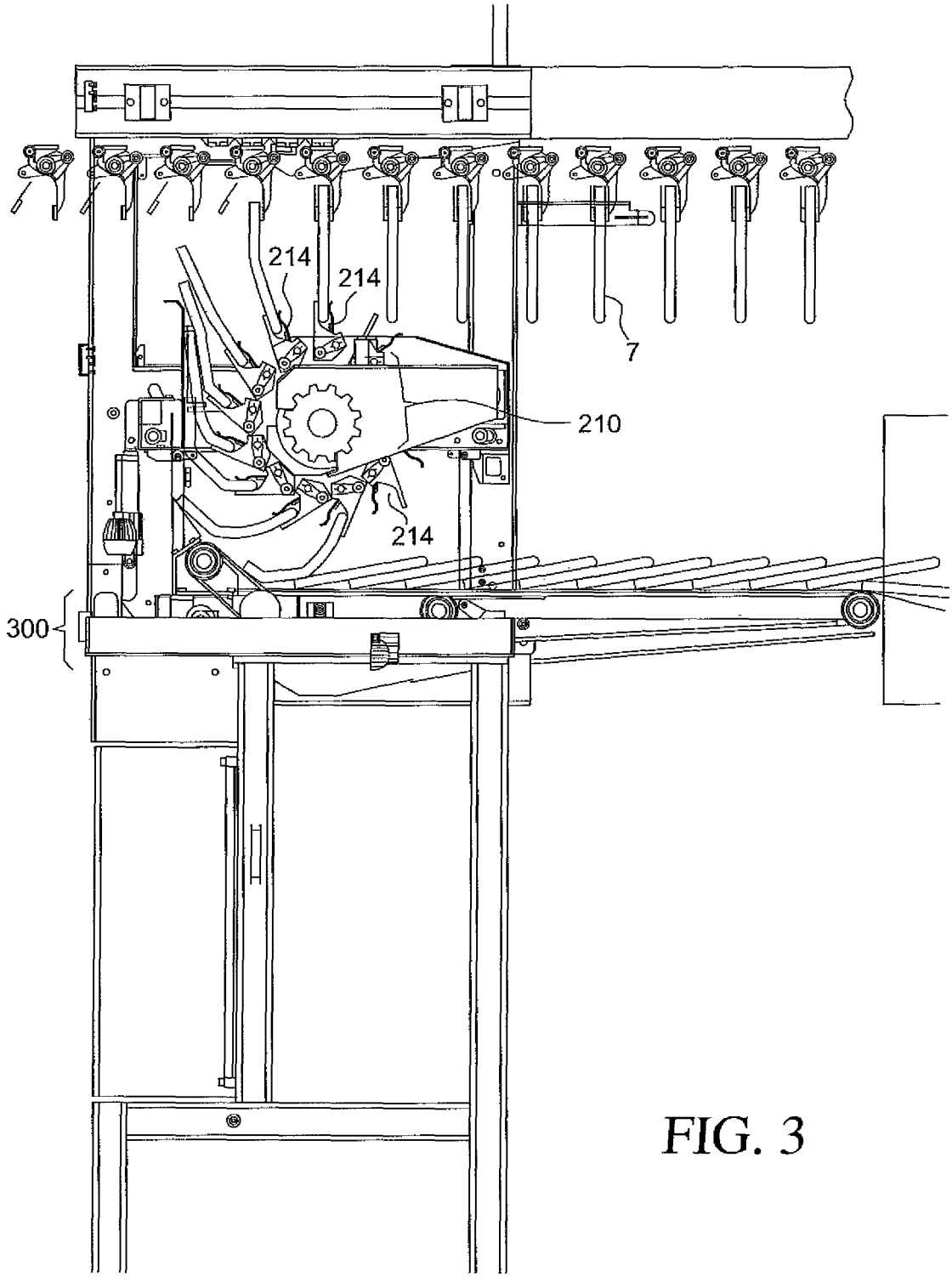
FIG. 3 is a magnified view of a portion of the stacker infeed depicted in FIG. 1.

FIG. 1 illustrates stacker infeed 1 in the context of its use, and FIGS. 2-3 further illustrate the infeed itself. The infeed rests on a frame 10 having adjustable legs 12. At its upper portion, a stream of packages 7 are provided from an inserter (not shown) that are conveyed via an overhead conveyor 3 to the stacker infeed. Here, they are transferred from the grippers 5 of the overhead conveyor 3 to the grippers 214 of a rotary gripper drum 210, and thence to a conveyer section 300 for transport to the inlet of a stacker 2. Generally speaking, in use a stacker will have a set height, which defines the height of its inlet.

The packages 7 that are conveyed to the stacker may vary in length and thus in the height of their lower edge above the gripper drum, so that a drum that is set at a height with respect to the overhead conveyer to accommodate a given size of package might prove to be too far or too close to the grippers of overhead conveyor for use with packages of another size, making their transfer difficult if not impossible. Also, the packages can vary in thickness, which affects the optimal distance between the gripper drum and the conveyer. The present invention provides for a gripper drum whose height with respect to the overhead conveyor can be varied, as can the height of the gripper drum with respect to the conveyer.

Figure 4:
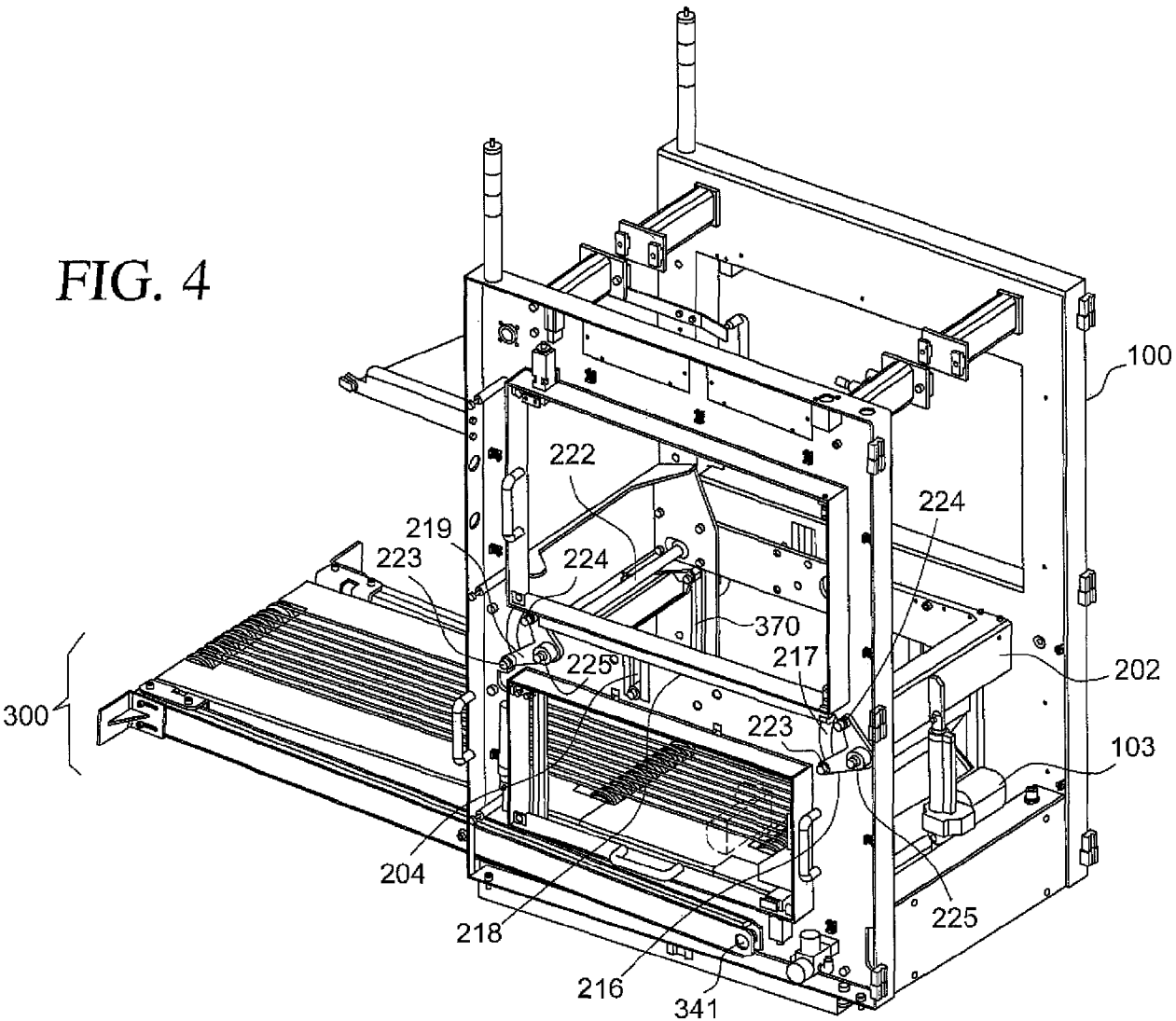
FIG. 4 is a perspective view of the housing of the stacker infeed assembly and elements of the conveyor system, with the drum removed.
Figure 5:
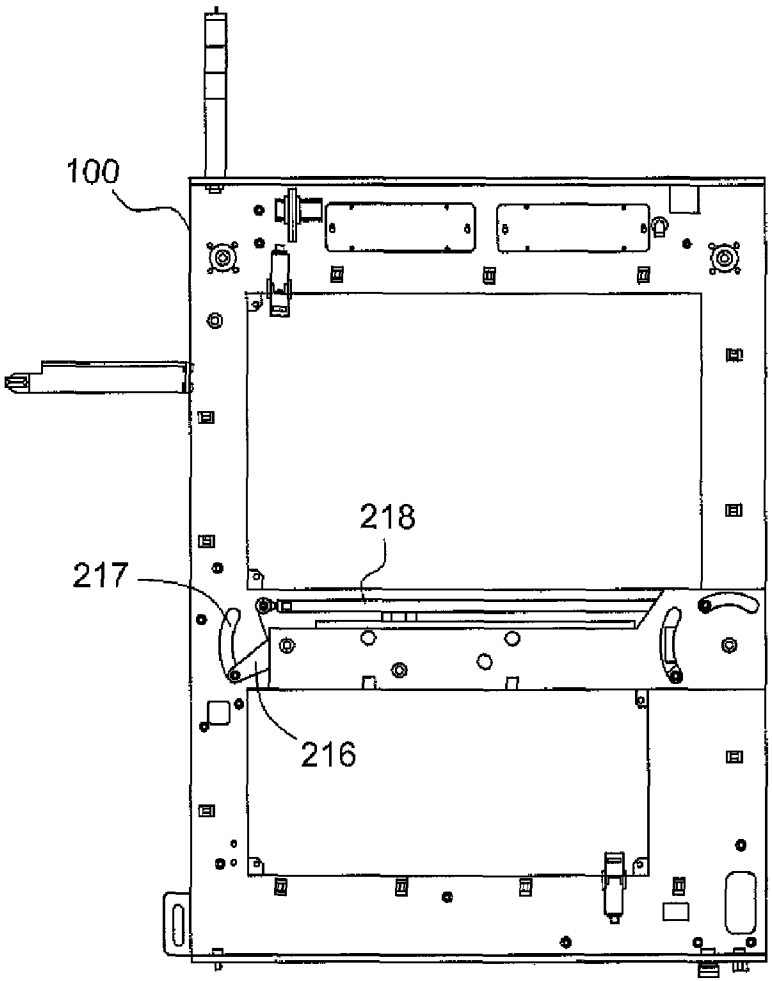
FIG. 5 is an elevational view of the outer frame of the infeed.

The gripper drum itself is mounted on an axle that is contained within an inner drum frame 202 (FIG. 4) that is connected to vertically extending drum guide slots 204 located on opposite sides of an outer frame 100, which constrain the drum axle to move in a vertical plane (see FIG. 4, which shows this with the drum removed. The outer frame 100 is fixed, or "ground". The inner drum frame 202 can move vertically with respect to the outer frame 100, subject to the geometric constraints provided by the guide slots 204. Vertical movement of the guide drum thus is accomplished by raising or lowering the inner drum frame 202 with respect to the outer frame 100, as shall now be explained.

Mounted at opposite ends of the drum frame 202 is a pair of drum frame lifting rods 222. These carry the drum frame, and thus the gripper drum 210 as well. The ends of the drum frame lifting rods 222 penetrate the outer frame 100 at curved slots 217, where they are bolted at 223 to one end of a bell crank 216. The bell cranks, of which there are four in total, are pivotally attached to the outer frame 100 at pivot 225. Each of the two bell cranks is attached at its other end 224 to a tie rod 218, so that the movement of the right hand bell crank (in FIG. 4) about its pivot 225 causes the frame lifting rod 222 terminating at point 223 to move along the curved slot 217, and thus with a vertical component. Concomitantly, the tie rod 218 causes identical movements at the other bell crank and its associated lifting rod. Thus, movement imparted to one of the drum frame lifting rods causes identical movement of the other drum frame lifting rod, and thus of the drum frame 202 which, because of its connection to vertical guide slot 204, is constrained to move in the vertical direction. A linear actuator motor 103 mounted to the outer frame 100 is configured to drive one of the drum frame lifting rods 222, which moves the drum frame 202 (and hence the gripper drum 210 that it carries) vertically as described. Control over the linear actuator is provided by a switch, and a linear scale is provided on the frame to provide indication of the magnitude of vertical movement provided. In the illustrated embodiment, the actuator can move the gripper drum a maximum of three vertical inches, although greater range of movement can be provided if needed.

A set of four lift links 370 are provided, one at each of the corners of the drum frame 202 and pivotally connected thereto. The opposite ends of the four lift links 370 is connected to the conveyor assembly 300 as shown in FIG. 6, so that when the linear actuator 103 is activated to vertically move the gripper drum and the drum frame, the conveyor assembly immediately beneath the gripper drum is moved as well as shall be further explained below.

Figure 7:
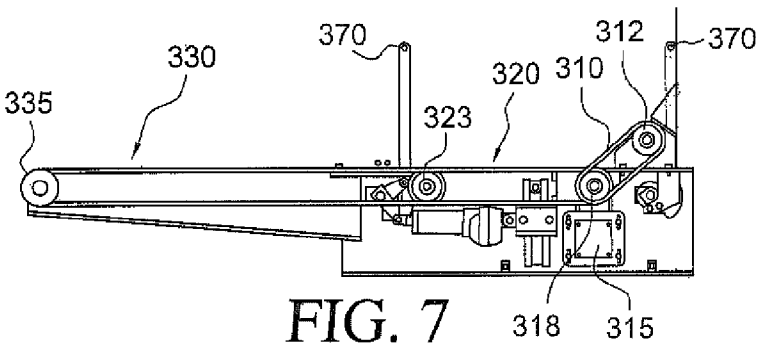
FIG. 7 is a cutaway side view of the conveyor assembly depicted in FIG. 6.
Figure 8:
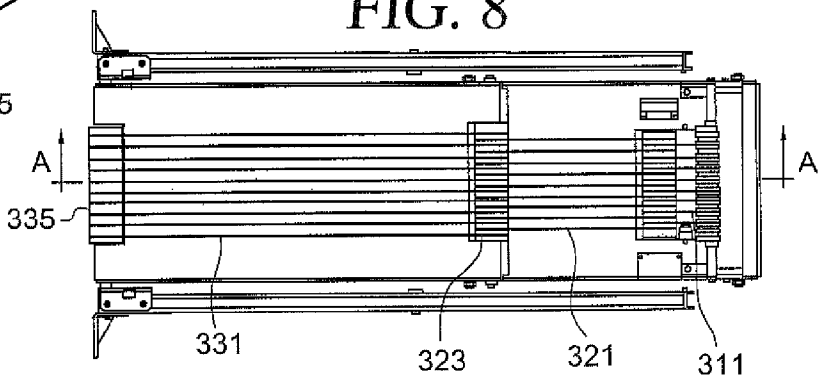
FIG. 8 is a top plan view of the conveyor assembly depicted in FIG. 6.
Figure 6:
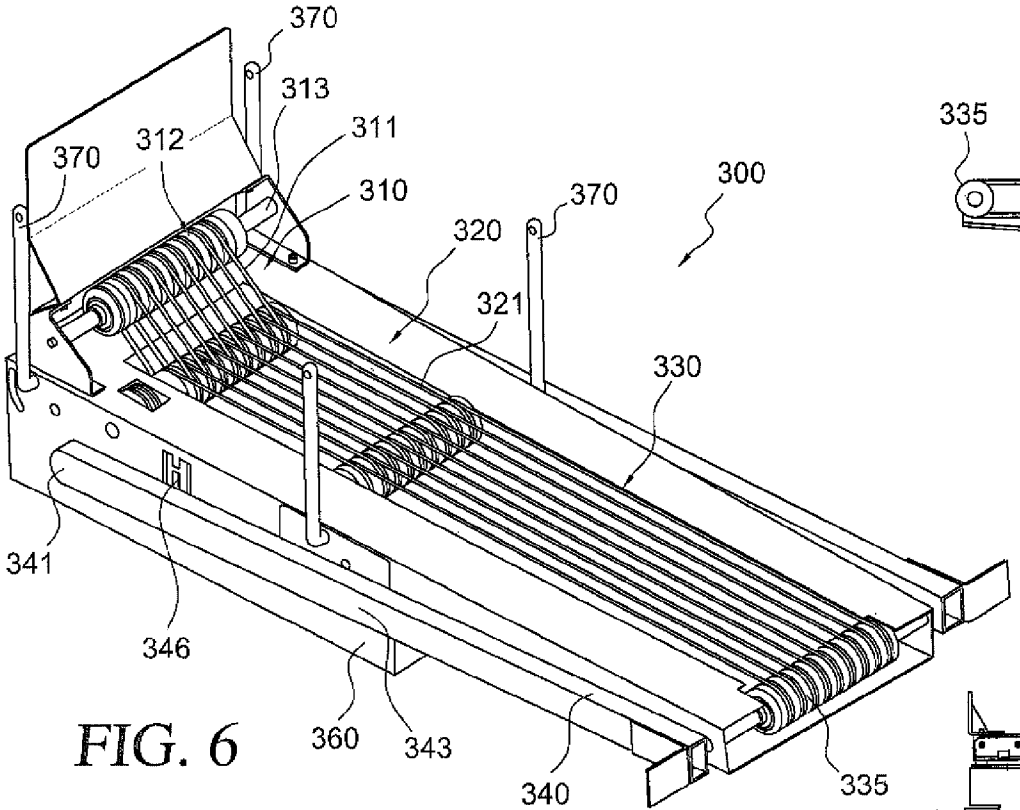
FIG. 6 is a perspective view of the conveyor assembly.

Referring now to FIGS. 6-8, the conveyor assembly 300 has three distinct conveyor sections: an inlet conveyor section 310, which is set at approximately a 45 degree angle with respect to the central conveyor section 320, and an outlet conveyor section 330. Each of the conveyor sections is constructed of a series of elastic bands bound by rows of pulleys. Inlet conveyor section 310 is angled so as to better direct the flow of packages towards the central conveyor section 320 as packages are released from the grippers of the gripper drum as shown in FIGS. 1 and 3.

Figure 10:
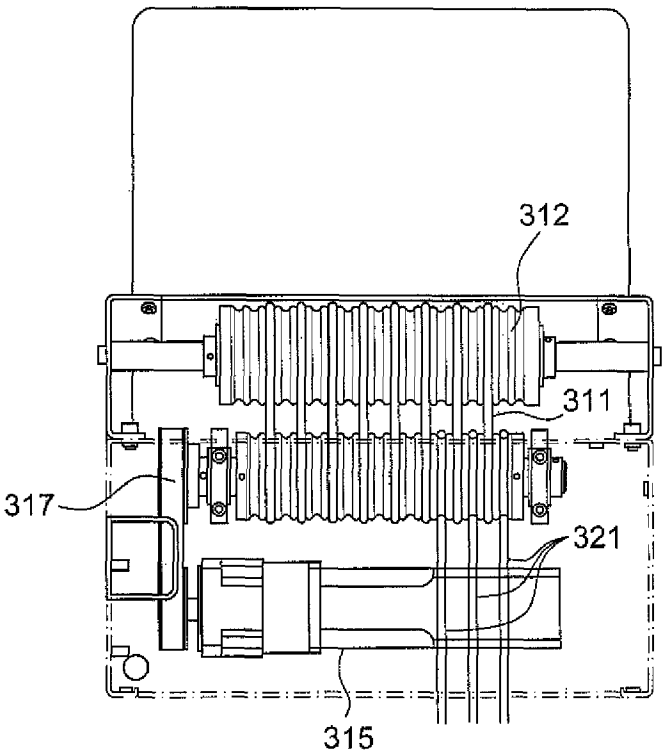
FIG. 10 is another view of a portion of the conveyor shown in FIG. 9, as viewed along a line orthogonal to this portion of the conveyor.
Figure 9:
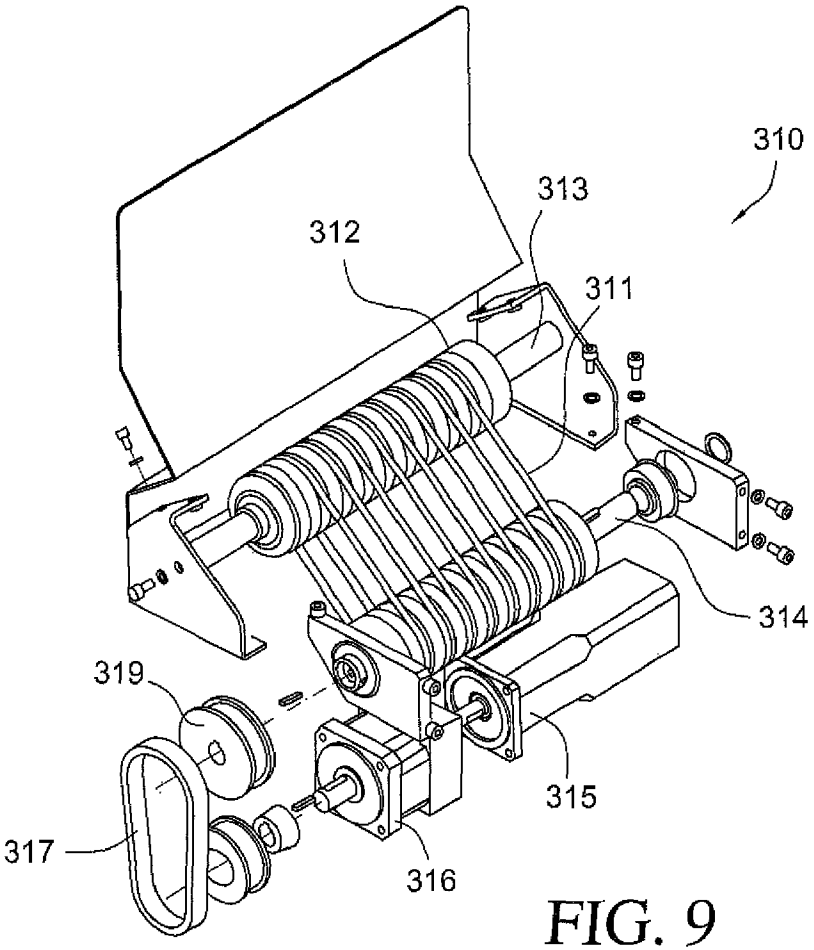
FIG. 9 is a partially exploded view of a portion of the conveyor.

The inlet conveyor section 310 is further illustrated in FIGS. 9 and 10. The elastic bands 311 wrap around a series of pulleys 312 that freely rotate about shaft 313 that is connected to the conveyor frame 360. The opposite ends of the elastic bands wrap around a second set of pulleys 318 that are mounted to a drive shaft 314 so that they are locked to that shaft and rotate therewith. Drive shaft 314 is driven by a servo motor 315 that, acting through a gear box 316, drives a belt 317 and a drive pulley 319 that is locked to the drive shaft 314. Hence, the servo motor 315 drives the pulleys 318 and the elastic bands 311.

The pulleys 318 each have two sets of groves, one to accommodate the elastic bands 311, and a second to accommodate another set of horizontally disposed elastic bands 321 (several of which are shown in FIG. 10). These bands 321 form the central conveyor section 320, and terminate at a freely rotating second set of pulleys 323 (see FIGS. 7 and 8), which like pulleys 318 have two sets of grooves. The second set of grooves of pulleys 323 accommodate the elastic bands 331 of outlet conveyor section 330 which terminates at pulleys 335. When the servomotor 315 is operating, it drives all three conveyor sections through the linkages provided at the pulleys by their respective elastic bands.

The far end of outlet conveyor section 330 is typically set at a fixed height in relation to the inlet of the stacker 2 and must remain at that height, even as the height of the gripper drum and the conveyor sections 310 and 320, as well as pulleys 323, is adjusted. The conveyor frame 360 includes a pair of tubular supports 340 (see FIG. 11) that are provided with a pair of horizontal guide slots 338 into which guide pins 337 are fitted. These guide pins are attached at their opposite ends to the shaft 339 bearing the pulleys 335. When the guide drum is vertically adjusted, this adjustment is transmitted via the four lift links 370 to the conveyor frame 360 and to the conveyor sections 310 and 320, which includes the pulleys 323 of outlet conveyor section 330. The free end of that conveyor section at pulleys 335, instead of changing elevation, instead slides horizontally as the guide pins 337 move within the horizontal guide slots 338. Thus, this arrangement accommodates the vertical movement of the central section of the conveyor without disturbing the vertical position of the far end of the outlet conveyor section, which is desired to remain in vertical registry with the inlet of the stacker.

Figure 11:
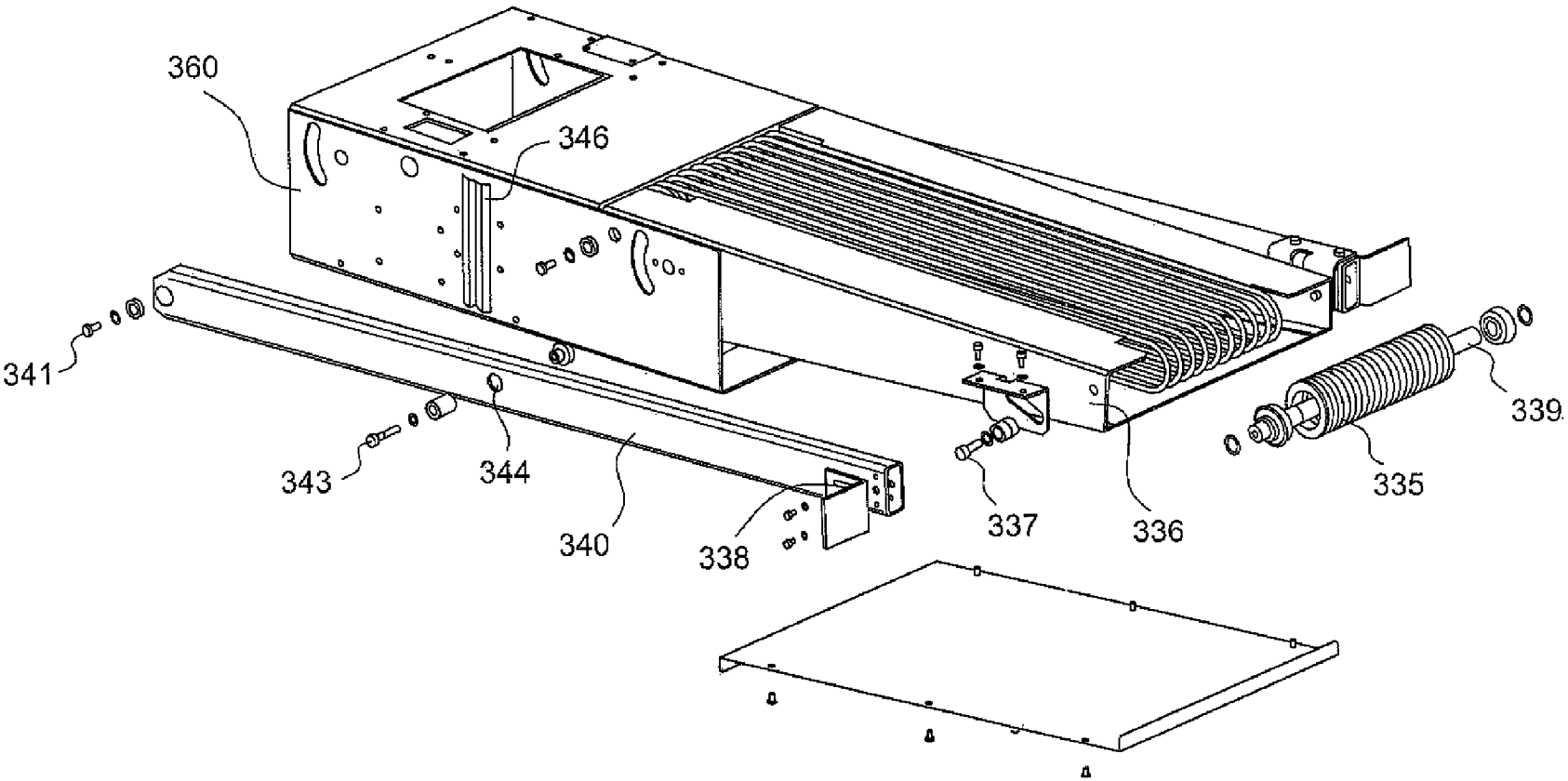
FIG. 11 is a perspective, partially disassembled view of the conveyor in its housing.

Although in use, the height of the free end of the conveyor is fixed, it is known that individual stacker inlets may vary some in height, so to provide an additional measure of adjustment, height of the free end of the outlet conveyor section 330 can be adjusted as follows. Tubular supports 340, which carry the shaft 339 bearing pulleys 335 of that section, is provided with a pivot at 341 about which the tube supports can be rotated, thereby altering the height of the free end of the outlet conveyor at 335. The height is then fixed into place by tightening a set screw 343 which is inserted into vertical window 346 of the conveyor frame (FIGS. 6 and 11).

As explained above, the distance between the gripper drum and the overhead conveyor can be adjusted, which also raises or lowers the height of the conveyor sections by a corresponding amount through the connection provided by the four lift links 370. It may be necessary to further adjust the distance between the gripper drum and the conveyor to most optimally accommodate packages of differing thickness. This further adjustment, which does not alter the distance between the gripper drum and the overhead conveyor, is provided for according to additional features of the embodiment set forth here.

Figure 13:
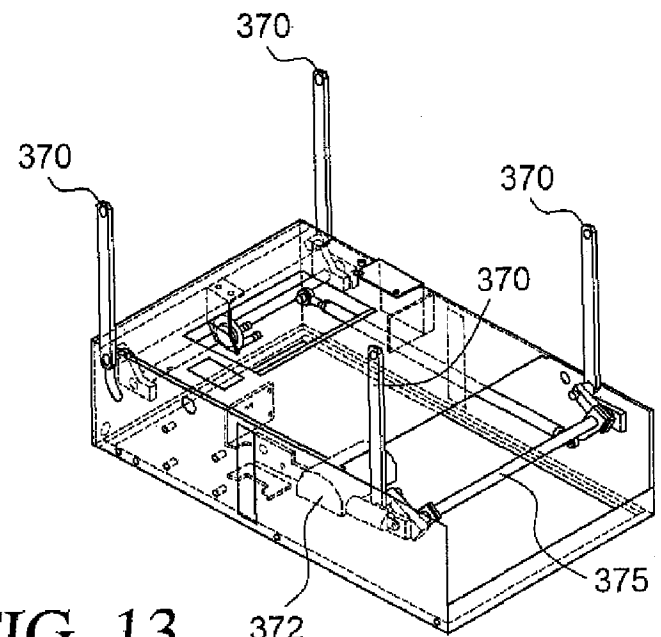
FIG. 13 shows the mechanism of FIG. 12 in its context.
Figure 12:
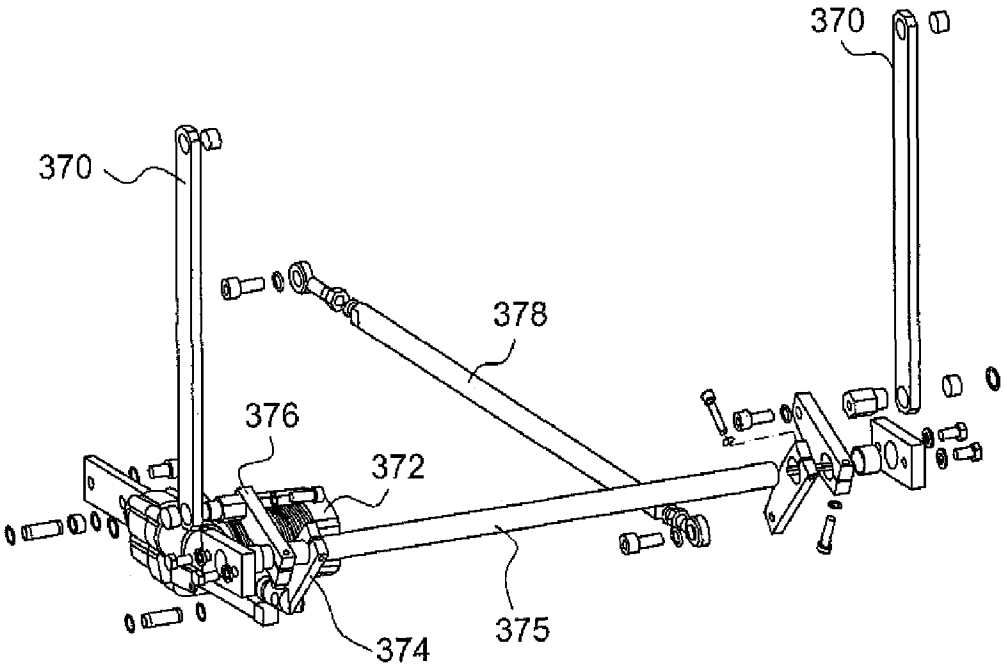
FIG. 12 is an exploded view of a mechanism used to adjust the height of the conveyor.

Referring now to FIGS. 12 and 13, linear motor 372 is connected to the frame of the conveyor. When activated, it pushes lift lever 374, which rotates and lifts lift shaft 375 while also pivoting it with respect to the lift link 370 via connecting link 376. A tie rod 378 transmits similar motion to corresponding structure at the other end of the housing. This causes the conveyor frame, which rests on the lift shafts 375, to move vertically without disturbing the vertical spacing previously set between the rotary gripper drum and the overhead conveyor. In the illustrated embodiment, this feature provides an additional three inches of vertical spacing adjustment between the conveyor section and the rotary gripper drum, for a total of six inches of vertical adjustment. It will be understood that more or less can be provided within the scope of this invention, and that the amount of adjustment available between the gripper drum and the overhead conveyer need not equal the amount provided between the gripper drum and the conveyor.

Although one embodiment has been shown and described, the invention is not limited to this embodiment. Modifications and variations will occur to those skilled in the art. The claims are intended to cover all changes and modifications that the preferred embodiments of the invention herein chosen for purposes of illustration which do not constitute a departure from the spirit and scope of the present invention.

What is claimed is:

1. An infeed for conveying packages from an overhead conveyor having conveyor grippers, comprising:

an outer frame;

a gripper drum frame attached to said outer frame so as to permit translator movement there between;

a gripper drum having a plurality of drum grippers with opposing jaws for receiving packages directly from the conveyor grippers, said gripper drum being attached to the gripper drum frame;

a first motor; and a first linkage connecting the first motor to the gripper drum frame so that upon actuation of the first motor, the gripper drum is translated with respect to the outer frame.

2. An infeed as set forth in claim 1, further comprising: a conveyor suspended beneath the gripper drum, wherein the displacement of the gripper drum also displaces the conveyor.

3. An infeed as set forth in claim 2, wherein the conveyor comprises: a first section; a second section; a third section; wherein the first section is set at an angle with respect to the second section, and wherein the third section has a terminal end whose position is fixable with respect to a position of the outer frame.

4. An infeed as set forth in claim 2, further comprising: a second motor; a second linkage connecting the motor to a frame housing the conveyor; wherein activation of the second motor displaces at least a portion of the conveyor with respect to the gripper claim without changing the position of the gripper drum with respect to the outer frame.

5. An infeed as set forth in claim 3, wherein the conveyor sections comprise bands of elastic.

6. An infeed as set forth in claim 1, wherein the linkage comprises a bell crank.

* * * * *